US005265438A

United States Patent [19]

Knowles et al.

[11] Patent Number: 5,265,438

[45] Date of Patent: Nov. 30, 1993

[54] DUAL RESTRICTOR FLOW CONTROL

[75] Inventors: Steven M. Knowles, Woodburn; Frederick J. Pilon, New Haven, both of Ind.

[73] Assignee: Aeroquip Corporation, Maumee, Ohio

[21] Appl. No.: 892,784

[22] Filed: Jun. 3, 1992

[51] Int. Cl.[5] ..... F25B 13/00

[52] U.S. Cl. ..... 62/324.6; 62/222; 62/527; 137/513.3

[58] Field of Search ..... 62/324.6, 527, 222; 137/512, 512.5, 513.3

[56] References Cited

U.S. PATENT DOCUMENTS 3,805,825 4/1974 Lovingham ..... 137/512
3,992,898 11/1976 Duell et al. ..... 62/324.6
4,009,592 3/1977 Boerger ..... 62/222
4,896,696 1/1990 Bradley et al. ..... 137/513.3
5,038,579 8/1991 Drucker ..... 62/324.6
5,056,560 10/1991 DeMartelaere ..... 137/614.04

OTHER PUBLICATIONS

Aeroquip Engineering: FD20 Flow Control Literature, 1 page.

*Primary Examiner*—Albert J. Makay
*Assistant Examiner*—William C. Doerrler
*Attorney, Agent, or Firm*—Emch, Schaffer, Schaub & Porcello Co.

[57] ABSTRACT

A fluid flow circuit intended for use with heat pumps having a flow control valve comprising a pair of restrictor assemblies positioned in opposed relationship. The first restrictor assembly provides for restricted flow in a first direction and unrestricted flow in the opposed and second direction. The second restrictor assembly provides for restricted flow in the second direction and unrestricted flow in the first and opposed direction.

9 Claims, 4 Drawing Sheets

DUAL RESTRICTOR FLOW CONTROL

BACKGROUND OF THE INVENTION

The present invention is applicable in fluid circuits such as those used in heat pump circuitry and may be used for the purpose of controlling the rate of fluid flow within the circuit in both one direction or in the opposed direction. In heat pump designs, the fluid circuit is designed to provide for cooling when the flow is in a specific direction within the circuit. If the flow within the circuit is reversed, the heat pump design will provide heating. It is well known that in heat pump operations, heat will move from a higher temperature to a lower temperature. Thus, if a heat transfer coil is kept at a lower temperature than its surroundings, it will pickup heat. Conversely, if the transfer coil is kept at higher temperature than its surroundings, it will give off heat. In the operation of a heat pump, in the cooling mode, cool refrigerant is passed through an indoor coil to accept heated ambient air from within a structure. The heated refrigerant is then run through a compressor to an outdoor coil wherein the heat is transferred outdoors. If the flow is reversed, a structure can be heated by having the refrigerant in an outdoor coil cooled sufficiently to draw heat from the outdoor ambient air which is then compressed and transferred to the indoor coil and then transferred as heat within the structure.

The flow of the refrigerant through the circuitry of the pump is usually controlled by a capillary tube device or a restrictor taken in combination with a capillary tube device. The capillary tubes are used to reduce pressure on the refrigerant therefore reducing the temperature of the refrigerant. Typically with capillary tube assemblies, there are two different capillary tubes and one or, more likely, two check valves that operate to route the refrigerant through one capillary tube for cooling and through the other capillary tube for heating. The use of such capillary tubes with or without a restrictor provides a continual source of problems in heat pump designs. The capillary tubes with their concomitant check valves and manifolds require at least six to seven different joints which must be brazed for installation. Each given joint provides a potential leak path for refrigerant thus providing a potential problem area. Further, the incorporation of the capillary tubes and/or restrictor combination is complicated in the design of heat pumps and many times internal filter screens are necessary to filter the refrigerant. The addition of such screens adds more complexity to the design of the heat pump.

Therefore, it is an object of the invention to provide a flow control mechanism which eliminates the complexities in design of the heat pump.

It is another object of the invention to minimize the number of braze joints within a heat pump circuit to thereby eliminate potential leak paths.

Finally, it is an object of the invention to provide precise metered flow for both the heating circuit and the cooling circuit of a heat pump.

SUMMARY OF THE INVENTION

These objects are realized by the present invention which provides for a dual restrictor flow control valve which is intended to replace the capillary tube structure common in some heat pumps. By replacing the capillary tube structure with a single valve mechanism the heat pump circuitry has been reduced in complexity by at least two capillary tubes, one or two check valves and two screens. The dual restrictor valve structure of the present invention is contained in a single unitary housing which requires only two brazed joints to install. Therefore, there are fewer potential leak paths and less complication in the circuitry of the heat pump. Further, the dual restrictor flow control incorporates internal filter screens and eliminates the need for external filter screens. Finally, the dual restrictor flow control valve of the present invention can be located anywhere in the liquid line assembly which runs between the condenser coil and the evaporator coil.

Referring now to the accompanying drawings, the present invention will be more readily understood upon review of the following detail description of the preferred embodiment.

DETAILED DESCRIPTION OF THE PREFERRED EMBODIMENT

Figure 1:
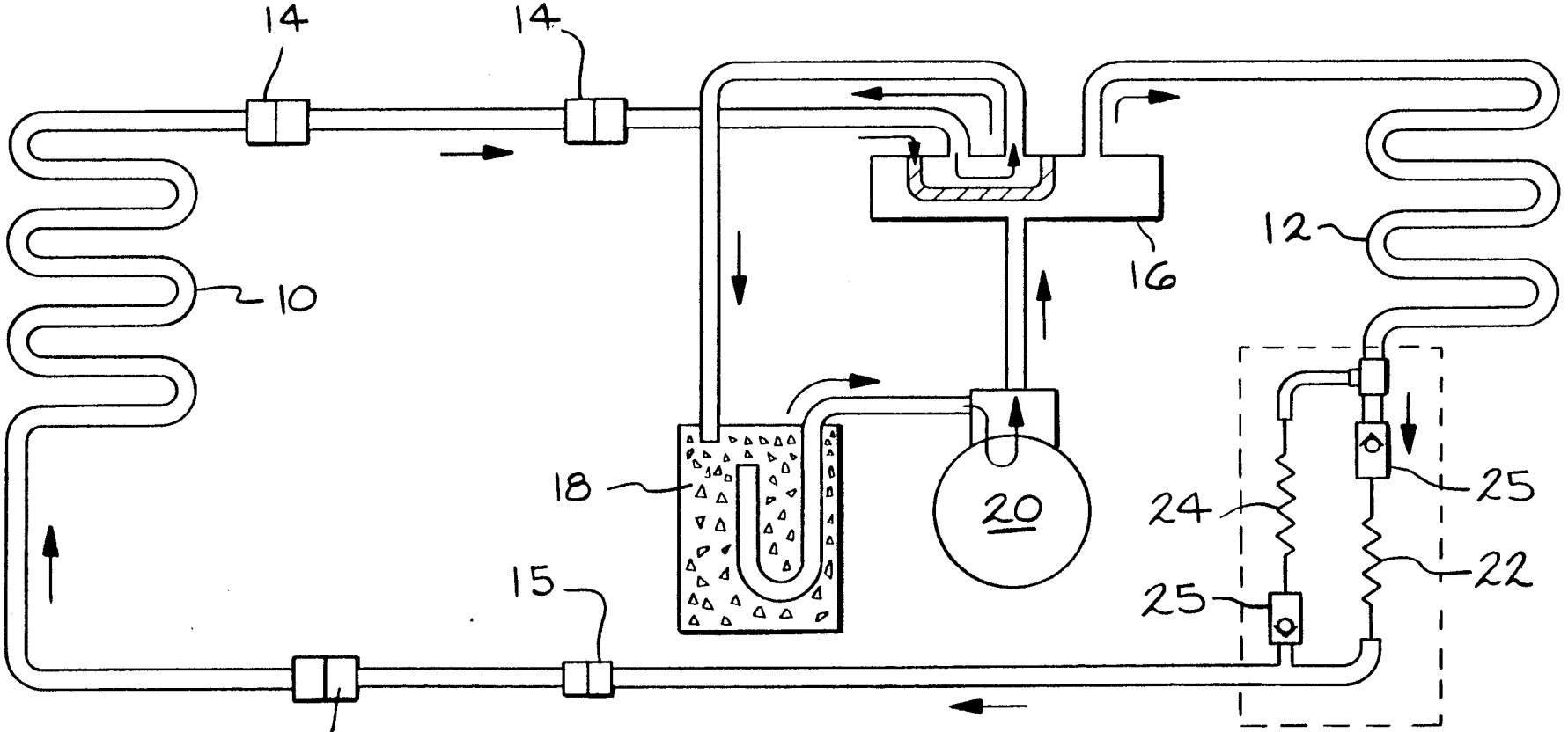
FIG. 1 PRIOR ART
FIG. 1 is a schematic diagram of a prior art heat pump fluid circuit.

Referring now to FIG. 1, a typical prior art fluid circuit for a heat pump is shown with the flow arrows indicating fluid flow for a cooling mode operation. The typical heat pump assembly includes an indoor coil 10 in communication with an outdoor coil 12. The coils 10, 12 are utilized to either absorb or radiate heat. In the cooling mode, the indoor coil absorbs heat from inside the structure and the outdoor coil is utilized to transfer the heat outdoors. If the flow were reversed, the outdoor coil would be utilized to absorb heat from the outdoor ambient air and the indoor coil would be utilized to transmit or transfer the heat indoors. This simple principle is achieved through the circuitry shown in FIG. 1 engaging the indoor coil 10 with the outdoor coil 12. In the cooling mode, fluid travels from the indoor coil through various couplings 14 to a reversing valve 16 which directs the fluid to an accumulator 18. The fluid, which is a cold gas at low pressure in the accumulator is drawn from the accumulator by the compressor 20 wherein it is pressurized and turned to hot gas. The hot gas then flows through the reversing valve 16 to the outdoor coil 12 where heat is exchanged with the outdoor ambient air and the gas reduces in temperature to the point it becomes a liquid refrigerant. The liquid refrigerant is then passed through a first capillary tube 22 wherein it is restricted causing it to expand to a mixed phase for delivery to the indoor coil 10. If the flow were reversed, the refrigerant liquid would flow through the second capillary tube 24 which would act to expand the refrigerant to a cool low pressure mixed phase which then would absorb heat from the outside ambient air through the outdoor coil 12 and flow through the reversing valve 16 into the accumulator 18 and then, on into the compressor 20. The compressor 20 then would act on the cool gas to create a high pressure hot gas which then would flow through the reversing valve 16 to the indoor coil 10 wherein the heat would be transmitted to the air within the structure. As the heat is transmitted the refrigerant would reduce to liquid and flow through the couplings 15 back to the capillary tube 24. The check valves 25 ensure that the refrigerant flows only through the required capillary tube 22 or 24, depending upon the direction of refrigerant flow. The complexity of the prior art fluid circuitry for heat pumps is relatively clear when looking at the various fittings, check valves, and capillary tubes shown within the area A which is circumscribed in ghost. It should be noted that the location of these components is dependent upon design. The components, located in area A, may be placed proximate the indoor coil 10 or the outdoor coil 12, as shown in FIG. 1. Also, the prior art designs are not limited solely to the use of capillary tubes but may also embody capillary tubes in combination with an orifice or expansion valve device (not shown).

Figure 2:
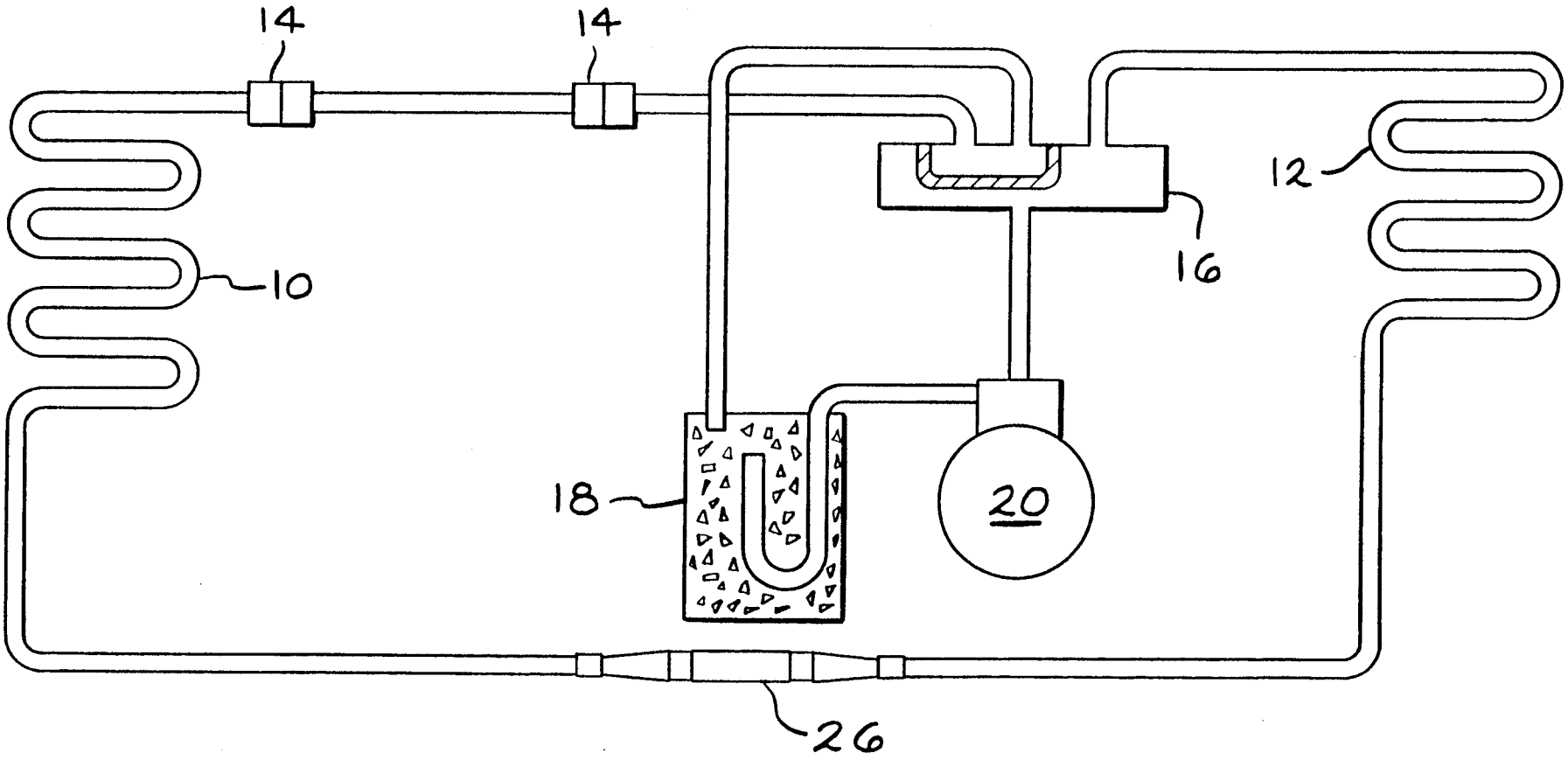
FIG. 2 is a schematic diagram of the present invention showing a heat pump fluid circuit incorporating the dual restrictor flow control valve.

Referring now to FIG. 2, it can be seen that the heat pump fluid circuitry is greatly simplified through the incorporation of a dual restrictor flow control valve 26 in substitution for the tubes and valves and couplings shown in the ghosted area A. The operation of the fluid circuit remains the same as that described with reference to FIG. 1. The flow control valve 26 replaces all the elements shown in ghosted area A, thus eliminating many brazed joints and their potential for leakage.

Figures 3, 3A:
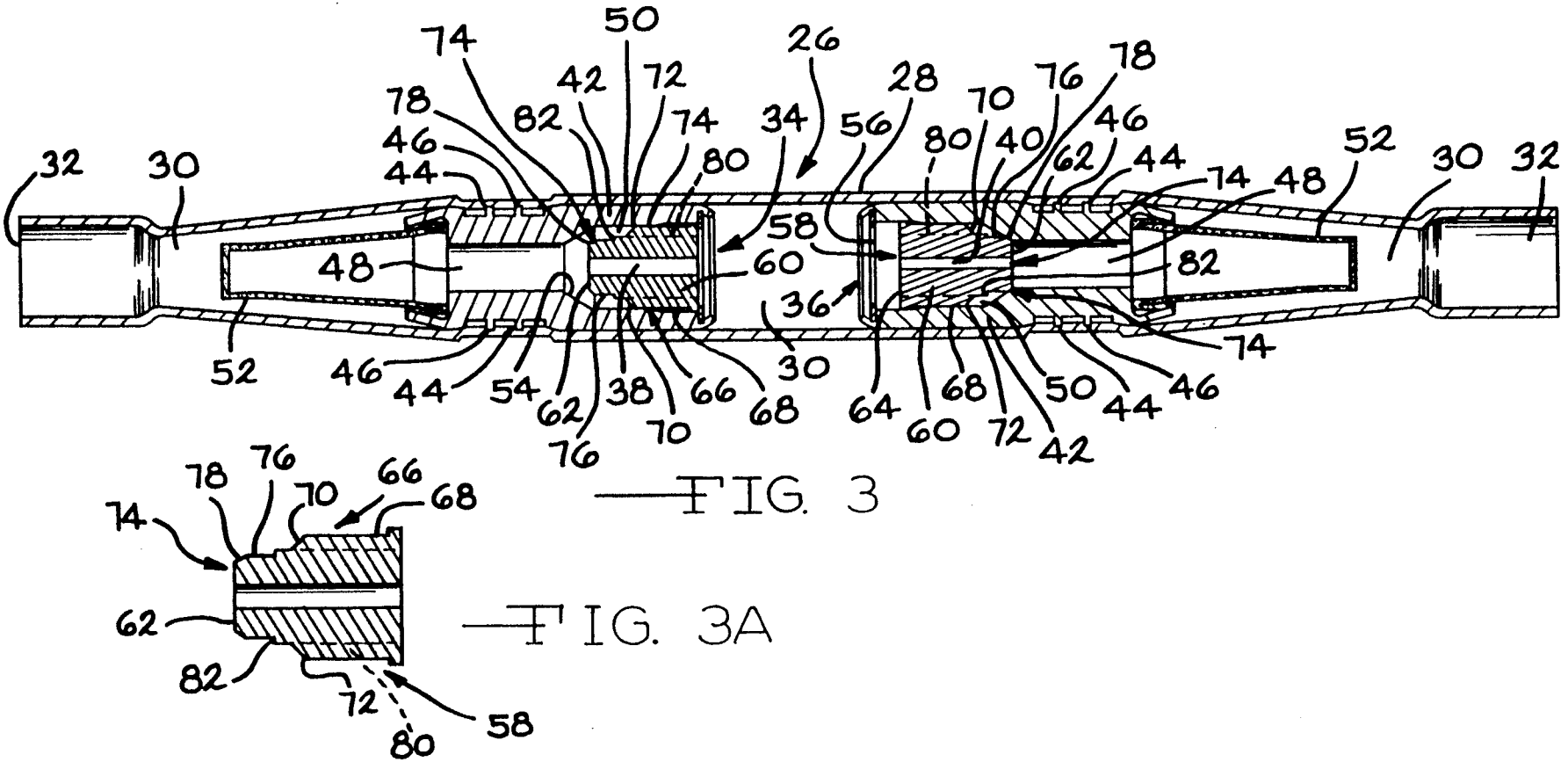
FIG. 3 is an elevated sectional view illustrating the dual restrictor flow control valve of FIG. 2.
FIG. 3A is a detailed side view of a restrictor intended for use with the flow control valve of FIG. 3.

Referring now to FIG. 3, the dual restrictor flow control 26 includes a unitary housing 28 defining a longitudinal cavity 30. The opposed ends 32 of the housing 28 are each configured to engage with and be fixed to the piping of the heat pump fluid circuit such as that shown in FIG. 2. A common method for connecting ends 32 with piping of the fluid circuit is brazing. A first restrictor assembly 34 and a second restrictor assembly 36 are enclosed within the cavity 30 of the housing 28. The first restrictor assembly 34 is designed to be in use during the cooling cycle of the heat pump and the second restrictor assembly 36 is designed to be in use during the heating cycle of the heat pump. The restrictors 34, 36 are operatively related so that when one restrictor is operational the remaining restrictor is in a by-pass configuration. The only distinction between the first restrictor assembly 34 and the second restrictor assembly 36 is the diameter of the orifice 38, 40 through which the refrigerant must pass when the respective restrictor 34, 36 is operational. The structure of the individual restrictor assemblies 34, 36 is discussed in detail in U.S. Pat. No. 4,896,696, the teachings of which are expressly incorporated herein.

With the exception of the diameter of the orifices 38, 40, the structure of the restrictors 34, 36 are identical. Therefore, for the sake of brevity, the structure of the restrictors 34, 36 will be described utilizing the same reference numerals. The restrictors 34, 36 each include a fitting member 42 which is fixed within the cavity 30 of the housing 28. Referring to FIG. 3, it can be seen that the fitting member 42 is engaged within the housing 28 by ring members 44 engaging slots 46 appearing in the housing 28 wall. The fitting member 42 defines a conduit 48 and a cylindrical chamber 50 which combine to extend longitudinally along the axis of the fitting member 42. A screen member 52 is fixed adjacent the conduit 48 at one end of the fitting member 42. The cylindrical chamber 50 includes a shoulder terminating in an annular sharp apex seat 54 which leads to the conduit 48. The opposed end of the cylindrical chamber 50 includes an annular radial anchor or shoulder surface 56. The restrictor member 58 is located within the chamber 50 and is of a length less then that of the chamber 50 so that the restrictor 58 may be axially displaced within the chamber 50 between alternative engagement with the seat 54 and the anchor surface 56. Preferably the chamber 50 has a diameter about 0.002 inches larger than the maximum diameter of the restrictor 58.

Figure 4:
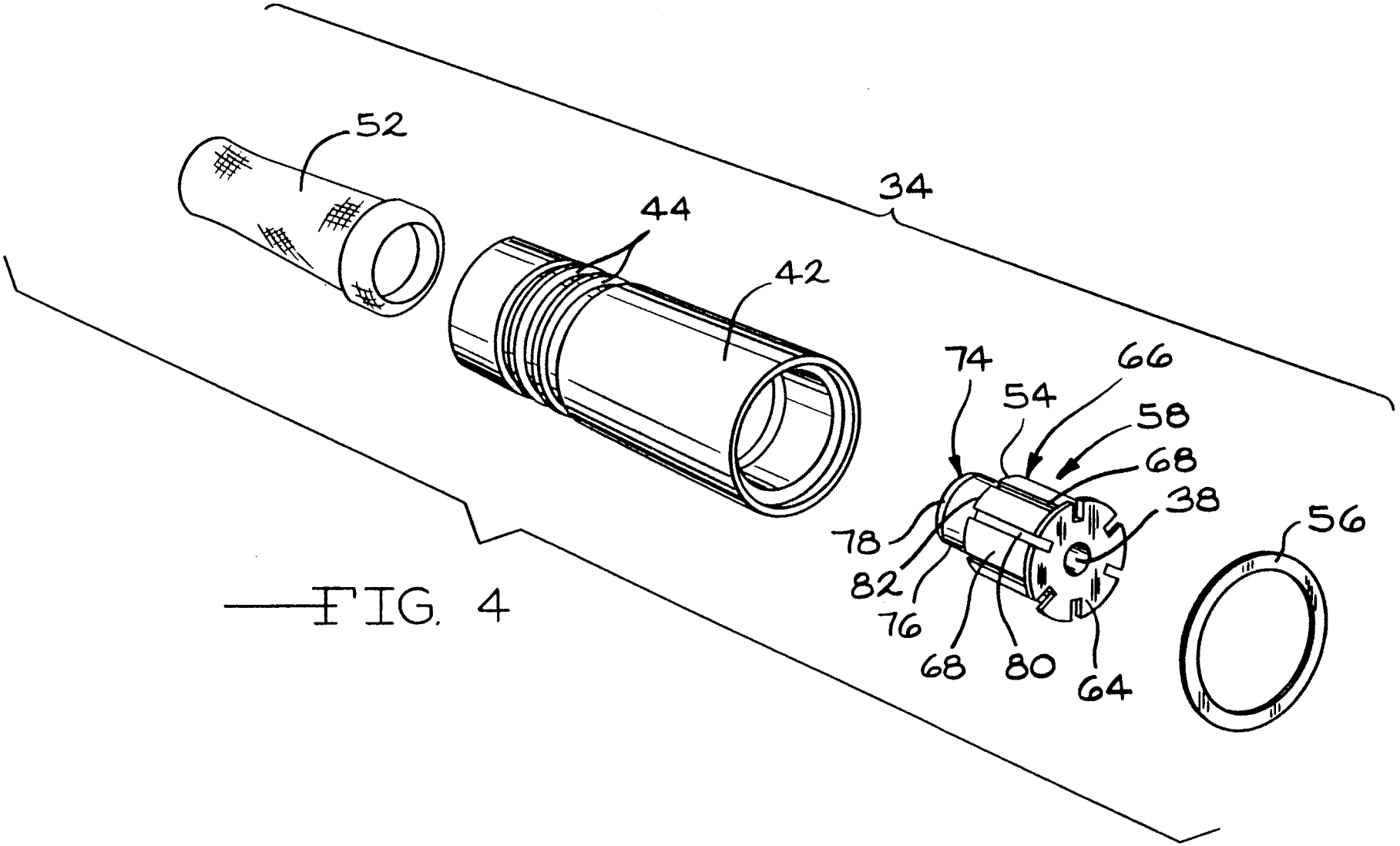
FIG. 4 is a perspective blow-up of one of the restrictor assemblies utilized in the flow control valve of FIG. 3.

Referring now to FIGS. 3, 3A and 4, the preferred embodiment of the restrictor 58 includes an elongated body 60 having a first end 62 and a second end 64, both of which are perpendicularly disposed to the axis of the axial orifice 38, 40 which intersects the ends. At least three radial vanes 66 are defined adjacent the second end 64 of the body and each includes an outer cylindrical segment end 68 which defines a diameter slightly less than the inner diameter of the chamber 50 within which the restrictor 58 is used. The forward edge of the vane 66 includes a surface 70 wherein the surface 70 and the vane ends 68 merge at radius 72. The opposed portion of the body 60 constitutes a nose region 74 which includes a smaller diameter cylindrical surface 76 intersecting the first body end 62 by means of a spherical segment transition surface 78. A larger diameter cylindrical flow surface 80 is defined on the elongated body 60 adjacent the vane surfaces 70 and an annular shoulder 82 separates the surfaces 76, 80. The annular shoulder 82 is perpendicularly disposed to the axis of the orifice 38, 40 and includes a sharp edge at the intersection of the face 82 and the surfaces 76, 80.

Referring now to FIG. 3, the dual restrictor flow control valve is shown in the heating operational mode. The transition surface 78 of the second restrictor assembly 36 is sealed against the seat 54 and the second end 64 of the first restrictor assembly 34 is seated against the anchor or shoulder surface 56 within the first restrictor assembly 34. In this position, the fluid flow will flow from left to right in viewing FIG. 3 and will flow over the surfaces 80, 76, of the first restrictor assembly 34 and flow through the second orifice 40 of the second restrictor assembly 36. If the system wishes to operate in the cooling mode, the fluid flow will be reversed and flow from right to left when viewing FIG. 3. The first restrictor assembly 34 will then engage the apex seat 54 with the transition surface 78 and the second end 64 of the second restrictor assembly 36 will seat against the anchor or shoulder surface 56 within the second restrictor assembly 36.

The present invention is field-replaceable and may be readily substituted in existing conduit systems for prior art type restrictors and capillary tubes. Restrictors of different diameter bores may be easily substituted to suit a particular circuit and it is appreciated that various modifications to the inventive concepts disclosed herein may be apparent to those skilled in the art without departing from the spirit and scope of the following claims.

We claim:

1. A flow control valve for regulating fluid flow comprising, in combination:

a housing member defining a longitudinal cavity extending therethrough;

a first restrictor assembly positioned for longitudinal movement within said cavity to restrict fluid flow to a first predetermined flow rate in a first direction and permit unrestricted fluid flow in a second and opposed direction; and a second restrictor assembly positioned independently of said first restrictor assembly for longitudinal movement within said cavity to restrict fluid flow to a second predetermined flow rate in such second direction and permit unrestricted fluid flow in the opposed and first direction.

2. A flow control valve as described in claim 1, wherein said first restrictor assembly includes a first orifice extending longitudinally therethrough, said first orifice being of a predetermined fixed diameter, and said second restrictor assembly including a second flow orifice extending longitudinally therethrough, said second orifice being of a smaller fixed diameter than said first orifice.

3. A flow control valve as described in claim 1, wherein said first and second restrictor assemblies further include screen members attached thereto.

4. A flow control valve for directing fluid flow comprising, in combination:

a housing member defining a longitudinal cavity extending therethrough;

a first restrictor assembly positioned within said cavity proximate one end of said housing member, said first restrictor assembly including a fitting member defining a conduit therethrough, said fitting member being fixed about the interior circumference of said cavity, said conduit defining a cylindrical chamber having a restrictor member positioned therein, said restrictor member having a first flow orifice of fixed diameter extending longitudinally therethrough and being axially movable within said cylindrical chamber between a first position determined to restrict fluid flow through said chamber and conduit to a first predetermined flow rate in a first direction and a second position permitting unrestricted fluid flow through said conduit and chamber in an opposed and second direction; and, a second restrictor assembly positioned independently of said first restrictor assembly within said cavity proximate said opposed end of said housing member, said second restrictor assembly including a second fitting member fixed about the inner circumference of said cavity, said second fitting member defining a conduit and a cylindrical chamber axially extending therethrough, a second restrictor member positioned within said second chamber for axial movement therein; said second restrictor member defining a second orifice of fixed diameter wherein said second restrictor member restricts fluid flow by means of said second orifice to a second predetermined flow rate in the second direction and permits unrestricted fluid flow in the opposed and first direction.

5. The flow control valve of claim 4, wherein said and second restrictor assemblies each include a screen member in communication with said conduits and positioned proximate said opposed ends of said housing member.

6. The flow control valve of claim 4, wherein said second orifice is of a smaller fixed diameter than said first orifice.

7. A reversible fluid flow circuit intended for use with a heat pump comprising, in combination:

an indoor coil member in communication with an outdoor coil member;

a compressor member positioned between said first and second coil members and engaged therewith; and, a flow control valve positioned between said first and second coil members and engaged therewith, such engagement between said flow control valve and said first and second coils being distinct from such engagement between said compressor member and said first and second coil members, wherein a loop-like circuit is formed between said first and second coils, said compressor member and said flow control valve;

said flow control valve including two independently positioned restrictor assemblies, a first restrictor assembly designed to restrict fluid flow to a first predetermined flow rate in a first direction and permit unrestricted fluid flow in a second and opposed direction, and a second restrictor assembly designed to restrict fluid flow to a second predetermined flow rate in such second direction and permit unrestricted fluid flow in the opposed and first direction.

8. A fluid flow circuit as described in claim 7, wherein said first restrictor assembly includes a first orifice extending longitudinally therethrough, said first orifice being of a fixed predetermined diameter, and a second restrictor assembly including a second flow orifice extending longitudinally therethrough, said second orifice being of a smaller fixed diameter than said first orifice.

9. A fluid flow circuit as described in claim 7, wherein said first and second restrictor assemblies further include screen members attached thereto.

* * * * *